US010090004B2

(12) United States Patent
Choo et al.

(10) Patent No.: US 10,090,004 B2
(45) Date of Patent: Oct. 2, 2018

(54) SIGNAL CLASSIFYING METHOD AND DEVICE, AND AUDIO ENCODING METHOD AND DEVICE USING SAME

(71) Applicant: SAMSUNG ELECTRONICS CO., LTD., Suwon-si (KR)

(72) Inventors: Ki-hyun Choo, Seoul (KR); Anton Viktorovich Porov, Saint-Petersburg (RU); Konstantin Sergeevich Osipov, Moscow (RU)

(73) Assignee: SAMSUNG ELECTRONICS CO., LTD., Suwon-shi (KR)

( * ) Notice: Subject to any disclaimer, the term of this patent is extended or adjusted under 35 U.S.C. 154(b) by 0 days.

(21) Appl. No.: 15/121,257

(22) PCT Filed: Feb. 24, 2015

(86) PCT No.: PCT/KR2015/001783
§ 371 (c)(1),
(2) Date: Sep. 28, 2016

(87) PCT Pub. No.: WO2015/126228
PCT Pub. Date: Aug. 27, 2015

(65) Prior Publication Data

US 2017/0011754 A1 Jan. 12, 2017

Related U.S. Application Data

(60) Provisional application No. 62/029,672, filed on Jul. 28, 2014, provisional application No. 61/943,638, filed on Feb. 24, 2014.

(51) Int. Cl.
*G10L 11/06* (2006.01)
*G10L 25/81* (2013.01)
(Continued)

(52) U.S. Cl.
CPC ..... *G10L 25/81* (2013.01); *G10L 19/005* (2013.01); *G10L 19/022* (2013.01);
(Continued)

(58) Field of Classification Search
CPC ..... G10L 17/02; G10L 25/81
(Continued)

(56) References Cited

U.S. PATENT DOCUMENTS 6,453,285 B1 9/2002 Anderson et al.
8,135,585 B2 3/2012 Lee et al.
(Continued)

FOREIGN PATENT DOCUMENTS

EP 2922052 A1 9/2015
WO 2009110751 A2 9/2009
(Continued)

OTHER PUBLICATIONS

Communication dated Apr. 30, 2015, issued by the International Searching Authority in counterpart International Application No. PCT/KR2015/001783 (PCT/ISA/210 and PCT/ISA/237).
(Continued)

*Primary Examiner* — Huyen Vo
(74) *Attorney, Agent, or Firm* — Sughrue Mion, PLLC

(57) ABSTRACT

The present invention relates to an audio encoding and, more particularly, to a signal classifying method and device, and an audio encoding method and device using the same, which can reduce a delay caused by an encoding mode switching while improving the quality of reconstructed sound. The signal classifying method may comprise the operations of: classifying a current frame into one of a speech signal and a music signal; determining, on the basis of a characteristic parameter obtained from multiple frames, whether a result of the classifying of the current frame includes an error; and correcting the result of the classifying of the current frame
(Continued)

in accordance with a result of the determination. By correcting an initial classification result of an audio signal on the basis of a correction parameter, the present invention can determine an optimum coding mode for the characteristic of an audio signal and can prevent frequent coding mode switching between frames.

11 Claims, 8 Drawing Sheets

(51) Int. Cl.
*G10L 19/20* (2013.01)
*G10L 19/005* (2013.01)
*G10L 19/02* (2013.01)
*G10L 19/022* (2013.01)
*G10L 19/125* (2013.01)

(52) U.S. Cl.
CPC ..... *G10L 19/0212* (2013.01); *G10L 19/125* (2013.01); *G10L 19/20* (2013.01)

(58) Field of Classification Search
USPC ..... 704/200–229, 500–504, 230–275
See application file for complete search history.

(56) References Cited

U.S. PATENT DOCUMENTS 8,903,720 B2 12/2014 Lee et al.
2010/0004926 A1* 1/2010 Neoran ..... G10L 25/48 704/201
2011/0046965 A1 2/2011 Taleb et al.
2011/0119067 A1 5/2011 Beack et al.
2011/0178796 A1* 7/2011 Liu ..... G10L 25/81 704/205
2012/0069899 A1 3/2012 Mehrotra et al.
2012/0158401 A1* 6/2012 Mazurenko ..... G10L 25/81 704/208
2013/0185063 A1* 7/2013 Atti ..... G10L 17/02 704/219
2014/0188465 A1 7/2014 Choo et al.

FOREIGN PATENT DOCUMENTS

WO 2010008173 A2 1/2010
WO 2010008179 A1 1/2010
WO 2014010175 A1 1/2014
WO 2014077591 A1 5/2014

OTHER PUBLICATIONS

Communication dated Sep. 28, 2017, from the European Patent Office in counterpart European Application No. 15751981.0.
Ludovic Tancerel et al., "Combined Speech and Audio Coding by Discrimination", Speech Coding, 2000. Proceedings. 2000 IEEE Workshop on Sep. 17-20, 2000, (pp. 154-156).
Vladimir Malenovsky et al., "Two-Stage Speech/Music Classifier With Decision Smoothing and Sharpening in The EVS Codec", 2015 IEEE International Conference on Acoustics, Speech and Signal Processing, Apr. 19, 2015, (pp. 5718-5722).

* cited by examiner

SIGNAL CLASSIFYING METHOD AND DEVICE, AND AUDIO ENCODING METHOD AND DEVICE USING SAME

TECHNICAL FIELD

One or more exemplary embodiments relate to audio encoding, and more particularly, to a signal classification method and apparatus capable of improving the quality of a restored sound and reducing a delay due to encoding mode switching and an audio encoding method and apparatus employing the same.

BACKGROUND ART

It is well known that a music signal is efficiently encoded in a frequency domain and a speech signal is efficiently encoded in a time domain. Therefore, various techniques of classifying whether an audio signal in which a music signal and a speech signal are mixed corresponds to the music signal or the speech signal and determining a coding mode in response to a result of the classification have been proposed.

However, frequent switching of coding modes induces the occurrence of a delay and deterioration of the quality of a restored sound, and a technique of correcting an initial classification result has not been proposed, and thus when there is an error in an initial signal classification, the deterioration of restored sound quality occurs.

DETAILED DESCRIPTION OF THE INVENTION

Technical Problem

One or more exemplary embodiments include a signal classification method and apparatus capable of improving restored sound quality by determining a coding mode so as to be suitable for characteristics of an audio signal and an audio encoding method and apparatus employing the same.

One or more exemplary embodiments include a signal classification method and apparatus capable of reducing a delay due to coding mode switching while determining a coding mode so as to be suitable for characteristics of an audio signal and an audio encoding method and apparatus employing the same.

Technical Solution

According to one or more exemplary embodiments, a signal classification method includes: classifying a current frame as one of a speech signal and a music signal; determining whether there is an error in a classification result of the current frame, based on feature parameters obtained from a plurality of frames; and correcting the classification result of the current frame in response to a result of the determination.

According to one or more exemplary embodiments, a signal classification apparatus includes at least one processor configured to classify a current frame as one of a speech signal and a music signal, determine whether there is an error in a classification result of the current frame, based on feature parameters obtained from a plurality of frames, and correct the classification result of the current frame in response to a result of the determination.

According to one or more exemplary embodiments, an audio encoding method includes: classifying a current frame as one of a speech signal and a music signal; determining whether there is an error in a classification result of the current frame, based on feature parameters obtained from a plurality of frames; correcting the classification result of the current frame in response to a result of the determination; and encoding the current frame based on the classification result of the current frame or the corrected classification result.

According to one or more exemplary embodiments, an audio encoding apparatus includes at least one processor configured to classify a current frame as one of a speech signal and a music signal, determine whether there is an error in a classification result of the current frame, based on feature parameters obtained from a plurality of frames, correct the classification result of the current frame in response to a result of the determination, and encode the current frame based on the classification result of the current frame or the corrected classification result.

Advantageous Effects of the Invention

By correcting an initial classification result of an audio signal based on a correction parameter, frequent switching of coding modes may be prevented while determining a coding mode optimized to characteristics of the audio signal.

MODE OF THE INVENTION

Hereinafter, an aspect of the present invention is described in detail with respect to the drawings. In the following description, when it is determined that a detailed description of relevant well-known functions or functions may obscure the essentials, the detailed description is omitted.

When it is described that a certain element is 'connected' or 'linked' to another element, it should be understood that the certain element may be connected or linked to another element directly or via another element in the middle.

Although terms, such as 'first' and 'second', can be used to describe various elements, the elements cannot be limited by the terms. The terms can be used to classify a certain element from another element.

Components appearing in the embodiments are independently shown to represent different characterized functions, and it is not indicated that each component is formed in separated hardware or a single software configuration unit. The components are shown as individual components for convenience of description, and one component may be formed by combining two of the components, or one component may be separated into a plurality of components to perform functions.

Figure 1:
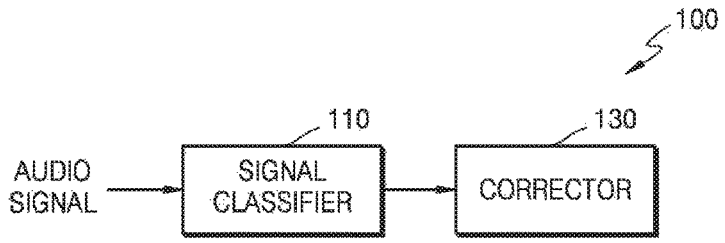
FIG. 1 is a block diagram of an audio signal classification apparatus according to an exemplary embodiment.

FIG. 1 is a block diagram illustrating a configuration of an audio signal classification apparatus according to an exemplary embodiment.

An audio signal classification apparatus 100 shown in FIG. 1 may include a signal classifier 110 and a corrector 130. Herein, the components may be integrated into at least one module and implemented as at least one processor (not shown) except for a case where it is needed to be implemented to separate pieces of hardware. In addition, an audio signal may indicate a music signal, a speech signal, or a mixed signal of music and speech.

Referring to FIG. 1, the signal classifier 110 may classify whether an audio signal corresponds to a music signal or a speech signal, based on various initial classification parameters. An audio signal classification process may include at least one operation. According to an embodiment, the audio signal may be classified as a music signal or a speech signal based on signal characteristics of a current frame and a plurality of previous frames. The signal characteristics may include at least one of a short-term characteristic and a long-term characteristic. In addition, the signal characteristics may include at least one of a time domain characteristic and a frequency domain characteristic. Herein, if the audio signal is classified as a speech signal, the audio signal may be coded using a code excited linear prediction (CELP)-type coder. If the audio signal is classified as a music signal, the audio signal may be coded using a transform coder. The transform coder may be, for example, a modified discrete cosine transform (MDCT) coder but is not limited thereto.

According to another exemplary embodiment, an audio signal classification process may include a first operation of classifying an audio signal as a speech signal and a generic audio signal, i.e., a music signal, according to whether the audio signal has a speech characteristic and a second operation of determining whether the generic audio signal is suitable for a generic signal audio coder (GSC). Whether the audio signal can be classified as a speech signal or a music signal may be determined by combining a classification result of the first operation and a classification result of the second operation. When the audio signal is classified as a speech signal, the audio signal may be encoded by a CELP-type coder. The CELP-type coder may include a plurality of modes among an unvoiced coding (UC) mode, a voiced coding (VC) mode, a transient coding (TC) mode, and a generic coding (GC) mode according to a bit rate or a signal characteristic. A generic signal audio coding (GSC) mode may be implemented by a separate coder or included as one mode of the CELP-type coder. When the audio signal is classified as a music signal, the audio signal may be encoded using the transform coder or a CELP/transform hybrid coder. In detail, the transform coder may be applied to a music signal, and the CELP/transform hybrid coder may be applied to a non-music signal, which is not a speech signal, or a signal in which music and speech are mixed. According to an embodiment, according to bandwidths, all of the CELP-type coder, the CELP/transform hybrid coder, and the transform coder may be used, or the CELP-type coder and the transform coder may be used. For example, the CELP-type coder and the transform coder may be used for a narrowband (NB), and the CELP-type coder, the CELP/transform hybrid coder, and the transform coder may be used for a wideband (WB), a super-wideband (SWB), and a full band (FB). The CELP/transform hybrid coder is obtained by combining an LP-based coder which operates in a time domain and a transform domain coder, and may be also referred to as a generic signal audio coder (GSC).

The signal classification of the first operation may be based on a Gaussian mixture model (GMM). Various signal characteristics may be used for the GMM. Examples of the signal characteristics may include open-loop pitch, normalized correlation, spectral envelope, tonal stability, signal's non-stationarity, LP residual error, spectral difference value, and spectral stationarity but are not limited thereto. Examples of signal characteristics used for the signal classification of the second operation may include spectral energy variation characteristic, tilt characteristic of LP analysis residual energy, high-band spectral peakiness characteristic, correlation characteristic, voicing characteristic, and tonal characteristic but are not limited thereto. The characteristics used for the first operation may be used to determine whether the audio signal has a speech characteristic or a non-speech characteristic in order to determine whether the CELP-type coder is suitable for encoding, and the characteristics used for the second operation may be used to determine whether the audio signal has a music characteristic or a non-music characteristic in order to determine whether the GSC is suitable for encoding. For example, one set of frames classified as a music signal in the first operation may be changed to a speech signal in the second operation and then encoded by one of the CELP modes. That is, when the audio signal is a signal of large correlation or an attack signal while having a large pitch period and high stability, the audio signal may be changed from a music signal to a speech signal in the second operation. A coding mode may be changed according to a result of the signal classification described above.

The corrector 130 may correct or maintain the classification result of the signal classifier 110 based on at least one correction parameter. The corrector 130 may correct or maintain the classification result of the signal classifier 110 based on context. For example, when a current frame is classified as a speech signal, the current frame may be corrected to a music signal or maintained as the speech signal, and when the current frame is classified as a music signal, the current frame may be corrected to a speech signal or maintained as the music signal. To determine whether there is an error in a classification result of the current frame, characteristics of a plurality of frames including the current frame may be used. For example, eight frames may be used, but the embodiment is not limited thereto.

The correction parameter may include a combination of at least one of characteristics such as tonality, linear prediction error, voicing, and correlation. Herein, the tonality may include tonality ton2 of a range of 1-2 KHz and tonality ton3 of a range of 2-4 KHz, which may be defined by Equations 1 and 2, respectively.

$$ton_2 = 0.2 * \log_{10}\left[\sqrt{\frac{1}{8}\sum_{i=0}^{7}\{tonality2^{[-i]}\}^2}\right] \quad (1)$$

$$ton_3 = 0.2 * \log_{10}\left[\sqrt{\frac{1}{8}\sum_{i=0}^{7}\{tonality3^{[-i]}\}^2}\right] \quad (2)$$

where a superscript [−j] denotes a previous frame. For example, tonality2$^{[-1]}$ denotes tonality of a range of 1-2 KHz of a one-frame previous frame.

Low-band long-term tonality $ton_{LT}$ may be defined as $ton_{LT}$=0.2* $\log_{10}$[It_tonality]. Herein, It_tonality may denote full-band long-term tonality.

A difference $d_{ft}$ between tonality ton2 of a range of 1-2 KHz and tonality ton3 of a range of 2-4 KHz in an nth frame may be defined as $d_{ft}$=0.2* {$\log_{10}$(tonality2(n))−$\log_{10}$(tonality3(n))).

Next, a linear prediction error $LP_{err}$ may be defined by Equation 3.

$$LP_{err} = \sqrt{\frac{1}{8}\sum_{i=0}^{7}[FV_s^{[-i]}(9)]^2} \quad (3)$$

where $FV_s(9)$ is defined as $FV_s(i)=sfa_iFV_i+sfb_i$ (i=0, . . . , 11) and corresponds to a value obtained by scaling an LP residual log-energy ratio feature parameter defined by Equation 4 among feature parameters used for the signal classifier 110 or 210. In addition, $sfa_i$ and $sfb_i$ may vary according to types of feature parameters and bandwidths and are used to approximate each feature parameter to a range of [0;1].

$$FV_9 = \log\left(\frac{E(13)}{E(1)}\right) + \log\left(\frac{E^{[-1]}(13)}{E^{[-1]}(1)}\right) \quad (4)$$

where E(1) denotes energy of a first LP coefficient, and E(13) denotes energy of a 13$^{th}$ LP coefficient.

Next, a difference $d_{vcor}$ between a value $FV_s(1)$ obtained by scaling a normalized correlation feature or a voicing feature $FV_1$, which is defined by Equation 5 among the feature parameters used for the signal classifier 110 or 210, based on $FV_s(i)=sfa_iFV_i+sfb_i$ (i=0, . . . , 11) and a value $FV_s(7)$ obtained by scaling a correlation map feature FV(7), which is defined by Equation 6, based on $FV_s(i)=sfa_iFV_i+sfb_i$ (i=0, . . . , 11) may be defined as $d_{vcor}=\max(FV_s(1)-FV_s(7),0)$.

$$FV_1 = C_{norm}^{[\cdot]} \quad (5)$$

where $C_{norm}^{[\cdot]}$ denotes a normalized correlation in a first or second half frame.

$$FV_7 = \sum_{j=0}^{127} M_{cor}(j) + \sum_{j=0}^{127} M_{cor}^{[-1]}(j) \quad (6)$$

where $M_{cor}$ denotes a correlation map of a frame.

A correction parameter including at least one of conditions 1 through 4 may be generated using the plurality of feature parameters, taken alone or in combination. Herein, the conditions 1 and 2 may indicate conditions by which a speech state SPEECH_STATE can be changed, and the conditions 3 and 4 may indicate conditions by which a music state MUSIC_STATE can be changed. In detail, the condition 1 enables the speech state SPEECH_STATE to be changed from 0 to 1, and the condition 2 enables the speech state SPEECH_STATE to be changed from 1 to 0. In addition, the condition 3 enables the music state MUSIC_STATE to be changed from 0 to 1, and the condition 4 enables the music state MUSIC_STATE to be changed from 1 to 0. The speech state SPEECH_STATE of 1 may indicate that a speech probability is high, that is, CELP-type coding is suitable, and the speech state SPEECH_STATE of 0 may indicate that non-speech probability is high. The music state MUSIC_STATE of 1 may indicate that transform coding is suitable, and the music state MUSIC_STATE of 0 may indicate that CELP/transform hybrid coding, i.e., GSC, is suitable. As another example, the music state MUSIC_STATE of 1 may indicate that transform coding is suitable, and the music state MUSIC_STATE of 0 may indicate that CELP-type coding is suitable.

The condition 1 ($f_A$) may be defined, for example, as follows. That is, when $d_{vcor}$>0.4 AND $d_{ft}$<0.1 AND $FV_s(1)>(2*FV_s(7)+0.12)$ AND $ton_2<d_{vcor}$ AND $ton_3<d_{vcor}$ AND $ton_{LT}<d_{vcor}$ AND $FV_s(7)<d_{vcor}$ AND $FV_s(1)>d_{vcor}$ AND $FV_s(1)>0.76$, $f_A$ may be set to 1.

The condition 2 ($f_B$) may be defined, for example, as follows. That is, when $d_{vcor}<0.4$, $f_B$ may be set to 1.

The condition 3 ($f_c$) may be defined, for example, as follows. That is, when $0.26<ton_2<0.54$ AND $ton_3>0.22$ AND $0.26<ton_{LT}<0.54$ AND $LP_{err}>0.5$, $f_C$ may be set to 1.

The condition 4 ($f_D$) may be defined, for example, as follows. That is, when $ton_2<0.34$ AND $ton_3<0.26$ AND $0.26<ton_{LT}<0.45$, $f_D$ may be set to 1.

A feature or a set of features used to generate each condition is not limited thereto. In addition, each constant value is only illustrative and may be set to an optimal value according to an implementation method.

In detail, the corrector 130 may correct errors in the initial classification result by using two independent state machines, for example, a speech state machine and a music state machine. Each state machine has two states, and hangover may be used in each state to prevent frequent transitions. The hangover may include, for example, six frames. When a hangover variable in the speech state machine is indicated by $hang_{sp}$, and a hangover variable in the music state machine is indicated by $hang_{mus}$, if a classification result is changed in a given state, each variable is initialized to 6, and thereafter, hangover decreases by 1 for each subsequent frame. A state change may occur only when hangover decreases to zero. In each state machine, a correction parameter generated by combining at least one feature extracted from the audio signal may be used.

Figure 2:
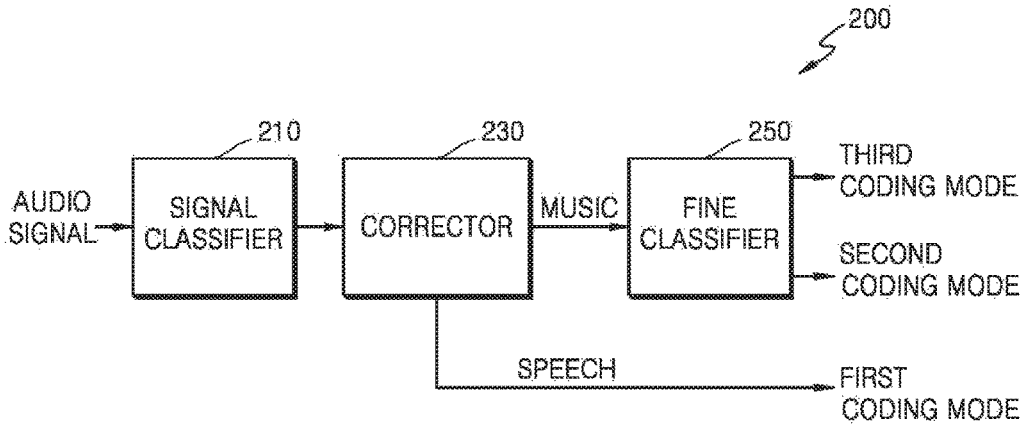
FIG. 2 is a block diagram of an audio signal classification apparatus according to another exemplary embodiment.

FIG. 2 is a block diagram illustrating a configuration of an audio signal classification apparatus according to another embodiment.

An audio signal classification apparatus 200 shown in FIG. 2 may include a signal classifier 210, a corrector 230, and a fine classifier 250. The audio signal classification apparatus 200 of FIG. 2 differs from the audio signal classification apparatus 100 of FIG. 1 in that the fine classifier 250 is further included, and functions of the signal classifier 210 and the corrector 230 are the same as described with reference to FIG. 1, and thus a detailed description thereof is omitted.

Referring to FIG. 2, the fine classifier 250 may finely classify the classification result corrected or maintained by the corrector 230, based on fine classification parameters. According to an embodiment, the fine classifier 250 is to correct the audio signal classified as a music signal by determining whether it is suitable that the audio signal is encoded by the CELP/transform hybrid coder, i.e., a GSC. In this case, as a correction method, a specific parameter or a flag is changed not to select the transform coder. When the classification result output from the corrector 230 indicates a music signal, the fine classifier 250 may perform fine classification again to classify whether the audio signal is a music signal or a speech signal. When a classification result of the fine classifier 250 indicates a music signal, the transform coder may be used as well to encode the audio signal in a second coding mode, and when the classification result of the fine classifier 250 indicates a speech signal, the audio signal may be encoded using the CELP/transform hybrid coder in a third coding mode. When the classification result output from the corrector 230 indicates a speech signal, the audio signal may be encoded using the CELP-type coder in a first coding mode. The fine classification parameters may include, for example, features such as tonality, voicing, correlation, pitch gain, and pitch difference but are not limited thereto.

Figure 3:
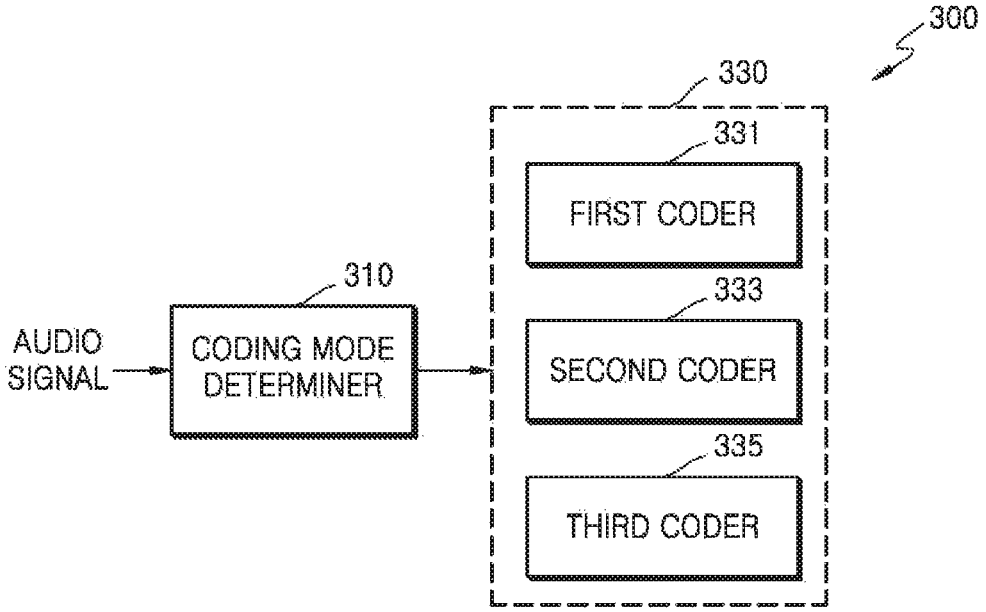
FIG. 3 is a block diagram of an audio encoding apparatus according to an exemplary embodiment.

FIG. 3 is a block diagram illustrating a configuration of an audio encoding apparatus according to an embodiment.

An audio encoding apparatus 300 shown in FIG. 3 may include a coding mode determiner 310 and an encoding module 330. The coding mode determiner 310 may include the components of the audio signal classification apparatus 100 of FIG. 1 or the audio signal classification apparatus 200 of FIG. 2. The encoding module 330 may include first through third coders 331, 333, and 335. Herein, the first coder 331 may correspond to the CELP-type coder, the second coder 333 may correspond to the CELP/transform hybrid coder, and the third coder 335 may correspond to the transform coder. When the GSC is implemented as one mode of the CELP-type coder, the encoding module 330 may include the first and third coders 331 and 335. The encoding module 330 and the first coder 331 may have various configurations according to bit rates or bandwidths.

Referring to FIG. 3, the coding mode determiner 310 may classify whether an audio signal is a music signal or a speech signal, based on a signal characteristic, and determine a coding mode in response to a classification result. The coding mode may be performed in a super-frame unit, a frame unit, or a band unit. Alternatively, the coding mode may be performed in a unit of a plurality of super-frame groups, a plurality of frame groups, or a plurality of band groups. Herein, examples of the coding mode may include two types of a transform domain mode and a linear prediction domain mode but are not limited thereto. The linear prediction domain mode may include the UC, VC, TC, and GC modes. The GSC mode may be classified as a separate coding mode or included in a sub-mode of the linear prediction domain mode. When the performance, processing speed, and the like of a processor are supported, and a delay due to coding mode switching can be solved, the coding mode may be further subdivided, and a coding scheme may also be subdivided in response to the coding mode. In detail, the coding mode determiner 310 may classify the audio signal as one of a music signal and a speech signal based on the initial classification parameters. The coding mode determiner 310 may correct a classification result as a music signal to a speech signal or maintain the music signal or correct a classification result as a speech signal to a music signal or maintain the speech signal, based on the correction parameter. The coding mode determiner 310 may classify the corrected or maintained classification result, e.g., the classification result as a music signal, as one of a music signal and a speech signal based on the fine classification parameters. The coding mode determiner 310 may determine a coding mode by using the final classification result. According to an embodiment, the coding mode determiner 310 may determine the coding mode based on at least one of a bit rate and a bandwidth.

In the encoding module 330, the first coder 331 may operate when the classification result of the corrector 130 or 230 corresponds to a speech signal. The second coder 333 may operate when the classification result of the corrector 130 corresponds to a music signal, or when the classification result of the fine classifier 350 corresponds to a speech signal. The third coder 335 may operate when the classification result of the corrector 130 corresponds to a music signal, or when the classification result of the fine classifier 350 corresponds to a music signal.

Figure 4:
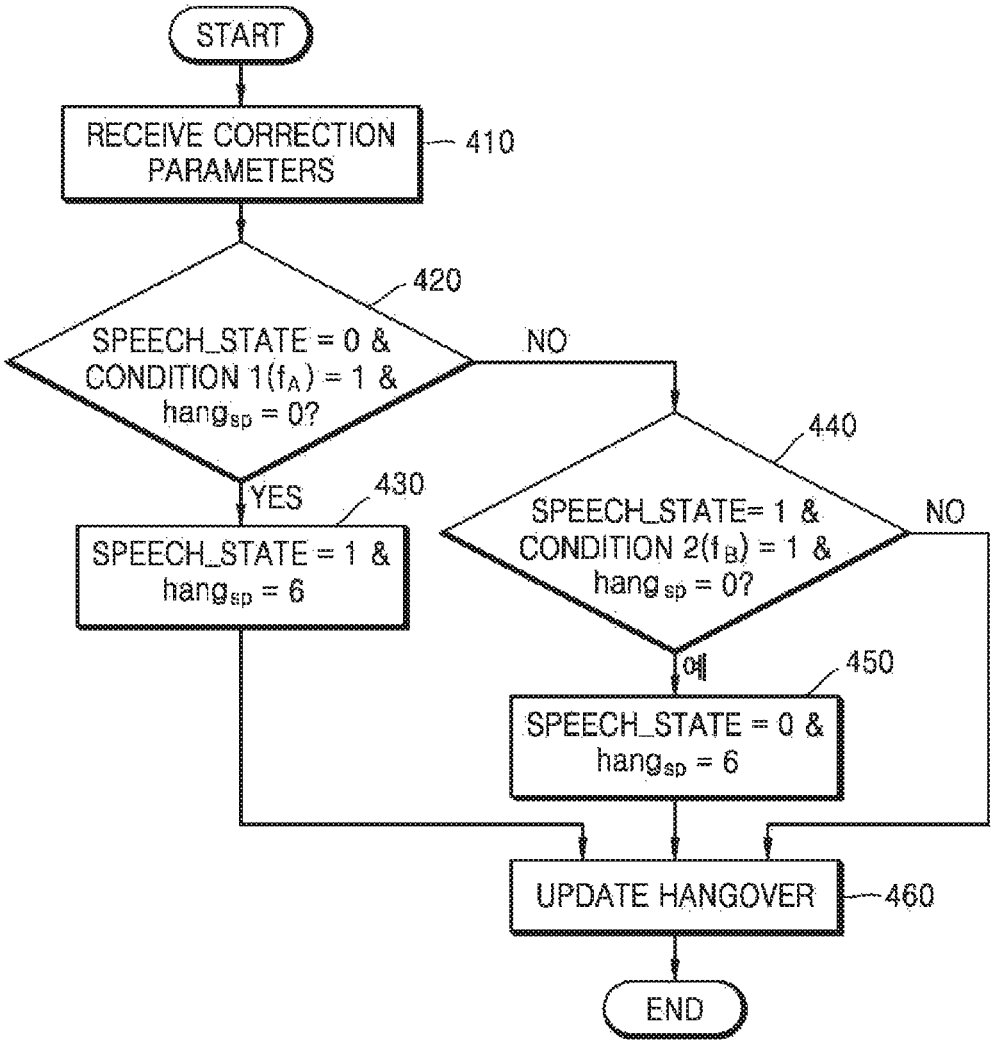
FIG. 4 is a flowchart for describing a method of correcting signal classification in a CELP core, according to an exemplary embodiment.

FIG. 4 is a flowchart for describing a method of correcting signal classification in a CELP core, according to an embodiment, and may be performed by the corrector 130 or 230 of FIG. 1 or 2.

Referring to FIG. 4, in operation 410, correction parameters, e.g., the condition 1 and the condition 2, may be received. In addition, in operation 410, hangover information of the speech state machine may be received. In operation 410, an initial classification result may also be received. The initial classification result may be provided from the signal classifier 110 or 210 of FIG. 1 or 2.

In operation 420, it may be determined whether the initial classification result, i.e., the speech state, is 0, the condition 1 ($f_A$) is 1, and the hangover $hang_{sp}$ of the speech state machine is 0. If it is determined in operation 420 that the initial classification result, i.e., the speech state, is 0, the condition 1 is 1, and the hangover $hang_{sp}$ of the speech state machine is 0, in operation 430, the speech state may be changed to 1, and the hangover may be initialized to 6. The initialized hangover value may be provided to operation 460. Otherwise, if the speech state is not 0, the condition 1 is not 1, or the hangover $hang_{sp}$ of the speech state machine is not 0 in operation 420, the method may proceed to operation 440.

In operation 440, it may be determined whether the initial classification result, i.e., the speech state, is 1, the condition 2 ($f_B$) is 1, and the hangover $hang_{sp}$ of the speech state machine is 0. If it is determined in operation 440 that the speech state is 1, the condition 2 is 1, and the hangover $hang_{sp}$ of the speech state machine is 0, in operation 450, the speech state may be changed to 0, and the $hangover_{sp}$ may be initialized to 6. The initialized hangover value may be provided to operation 460. Otherwise, if the speech state is not 1, the condition 2 is not 1, or the hangover $hang_{sp}$ of the speech state machine is not 0 in operation 440, the method may proceed to operation 460 to perform a hangover update for decreasing the hangover by 1.

Figure 5:
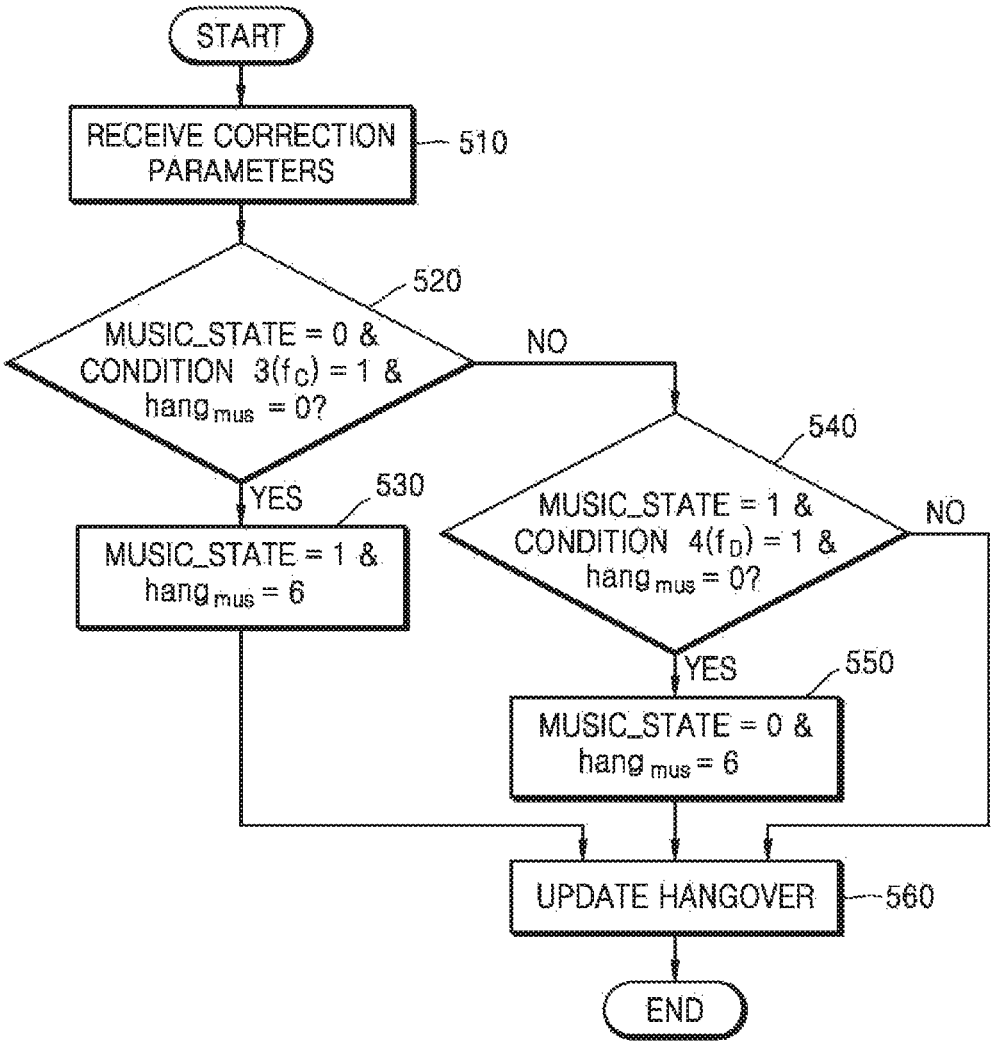
FIG. 5 is a flowchart for describing a method of correcting signal classification in an HQ core, according to an exemplary embodiment.

FIG. 5 is a flowchart for describing a method of correcting signal classification in a high quality (HQ) core, according to an embodiment, which may be performed by the corrector 130 or 230 of FIG. 1 or 2.

Referring to FIG. 5, in operation 510, correction parameters, e.g., the condition 3 and the condition 4, may be received. In addition, in operation 510, hangover information of the music state machine may be received. In operation 510, an initial classification result may also be received. The initial classification result may be provided from the signal classifier 110 or 210 of FIG. 1 or 2.

In operation 520, it may be determined whether the initial classification result, i.e., the music state, is 1, the condition 3($f_c$) is 1, and the hangover $hang_{mus}$ of the music state machine is 0. If it is determined in operation 520 that the initial classification result, i.e., the music state, is 1, the condition 3 is 1, and the hangover $hang_{mus}$ of the music state machine is 0, in operation 530, the music state may be changed to 0, and the hangover may be initialized to 6. The initialized hangover value may be provided to operation 560. Otherwise, if the music state is not 1, the condition 3 is not 1, or the hangover $hang_{mus}$ of the music state machine is not 0 in operation 520, the method may proceed to operation 540.

In operation 540, it may be determined whether the initial classification result, i.e., the music state, is 0, the condition 4 ($f_D$) is 1, and the hangover $hang_{mus}$ of the music state machine is 0. If it is determined in operation 540 that the music state is 0, the condition 4 is 1, and the hangover $hang_{mus}$ of the music state machine is 0, in operation 550, the music state may be changed to 1, and the hangover $hang_{mus}$ may be initialized to 6. The initialized hangover value may be provided to operation 560. Otherwise, if the music state is not 0, the condition 4 is not 1, or the hangover $hang_{mus}$ of the music state machine is not 0 in operation 540, the method may proceed to operation 560 to perform a hangover update for decreasing the hangover by 1.

Figure 6:
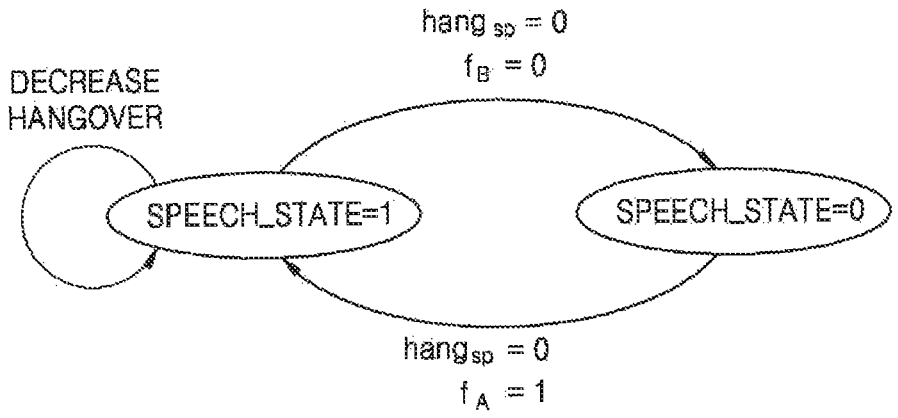
FIG. 6 illustrates a state machine for correction of context-based signal classification in the CELP core, according to an exemplary embodiment.

FIG. 6 illustrates a state machine for correction of context-based signal classification in a state suitable for the CELP core, i.e., in the speech state, according to an embodiment, and may correspond to FIG. 4.

Referring to FIG. 6, in the corrector (130 or 230 of FIG. 1), correction on a classification result may be applied according to a music state determined by the music state machine and a speech state determined by the speech state machine. For example, when an initial classification result is set to a music signal, the music signal may be changed to a speech signal based on correction parameters. In detail, when a classification result of a first operation of the initial classification result indicates a music signal, and the speech state is 1, both the classification result of the first operation and a classification result of a second operation may be changed to a speech signal. In this case, it may be determined that there is an error in the initial classification result, thereby correcting the classification result.

Figure 7:
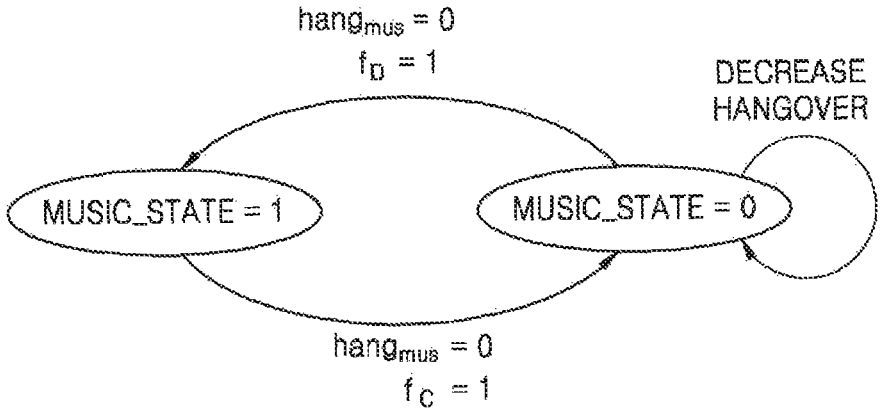
FIG. 7 illustrates a state machine for correction of context-based signal classification in the HQ core, according to an exemplary embodiment.

FIG. 7 illustrates a state machine for correction of context-based signal classification in a state for the high quality (HQ) core, i.e., in the music state, according to an embodiment, and may correspond to FIG. 5.

Referring to FIG. 7, in the corrector (130 or 230 of FIG. 1), correction on a classification result may be applied according to a music state determined by the music state machine and a speech state determined by the speech state machine. For example, when an initial classification result is set to a speech signal, the speech signal may be changed to a music signal based on correction parameters. In detail, when a classification result of a first operation of the initial classification result indicates a speech signal, and the music state is 1, both the classification result of the first operation and a classification result of a second operation may be changed to a music signal. When the initial classification result is set to a music signal, the music signal may be changed to a speech signal based on correction parameters. In this case, it may be determined that there is an error in the initial classification result, thereby correcting the classification result.

Figure 8:
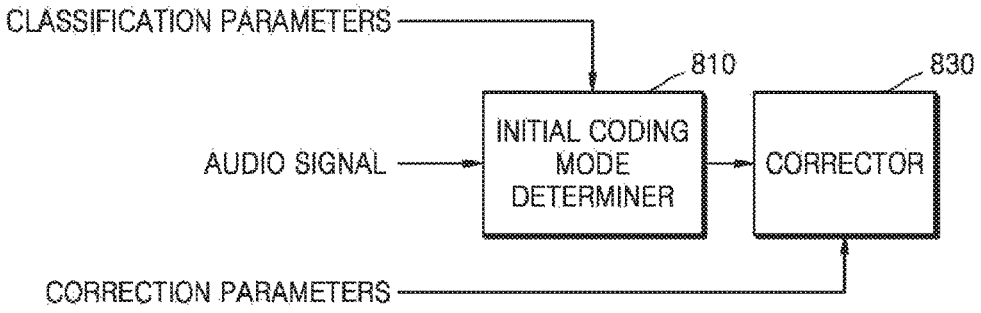
FIG. 8 is a block diagram of a coding mode determination apparatus according to an exemplary embodiment.

FIG. 8 is a block diagram illustrating a configuration of a coding mode determination apparatus according to an embodiment.

The coding mode determination apparatus shown in FIG. 8 may include an initial coding mode determiner 810 and a corrector 830.

Referring to FIG. 8, the initial coding mode determiner 810 may determine whether an audio signal has a speech characteristic and may determine the first coding mode as an initial coding mode when the audio signal has a speech characteristic. In the first coding mode, the audio signal may be encoded by the CELP-type coder. The initial coding mode determiner 810 may determine the second coding mode as the initial coding mode when the audio signal has non-speech characteristic. In the second coding mode, the audio signal may be encoded by the transform coder. Alternatively, when the audio signal has non-speech characteristic, the initial coding mode determiner 810 may determine one of the second coding mode and the third coding mode as the initial coding mode according to a bit rate. In the third coding mode, the audio signal may be encoded by the CELP/transform hybrid coder. According to an embodiment, the initial coding mode determiner 810 may use a three-way scheme.

When the initial coding mode is determined as the first coding mode, the corrector 830 may correct the initial coding mode to the second coding mode based on correction parameters. For example, when an initial classification result indicates a speech signal but has a music characteristic, the initial classification result may be corrected to a music signal. When the initial coding mode is determined as the second coding mode, the corrector 830 may correct the initial coding mode to the first coding mode or the third coding mode based on correction parameters. For example, when an initial classification result indicates a music signal but has a speech characteristic, the initial classification result may be corrected to a speech signal.

Figure 9:
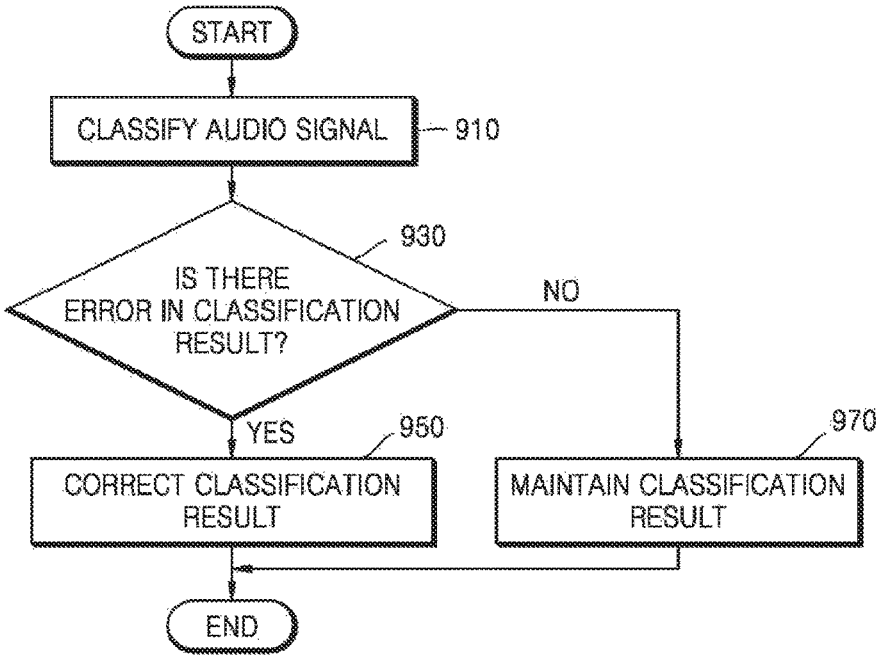
FIG. 9 is a flowchart for describing an audio signal classification method according to an exemplary embodiment.

FIG. 9 is a flowchart for describing an audio signal classification method according to an embodiment.

Referring to FIG. 9, in operation 910, an audio signal may be classified as one of a music signal and a speech signal. In detail, in operation 910, it may be classified based on a signal characteristic whether a current frame corresponds to a music signal or a speech signal. Operation 910 may be performed by the signal classifier 110 or 210 of FIG. 1 or 2.

In operation 930, it may be determined based on correction parameters whether there is an error in the classification result of operation 910. If it is determined in operation 930 that there is an error in the classification result, the classification result may be corrected in operation 950. If it is determined in operation 930 that there is no error in the classification result, the classification result may be maintained as it is in operation 970. Operations 930 through 970 may be performed by the corrector 130 or 230 of FIG. 1 or 2.

Figure 10:
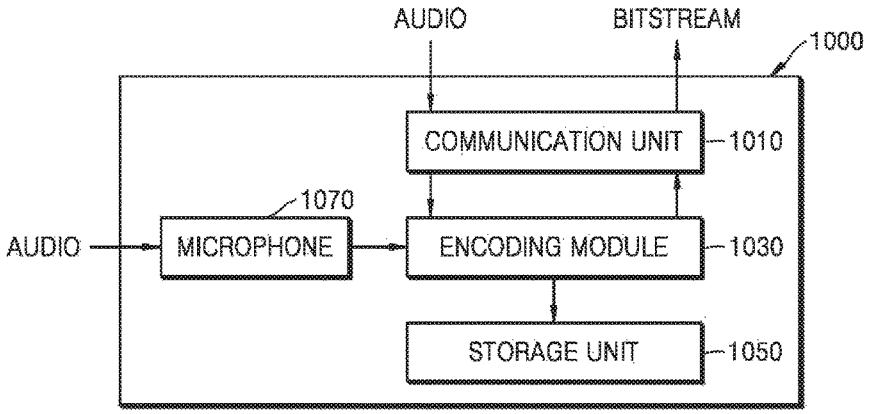
FIG. 10 is a block diagram of a multimedia device according to an exemplary embodiment.

FIG. 10 is a block diagram illustrating a configuration of a multimedia device according to an embodiment.

A multimedia device 1000 shown in FIG. 10 may include a communication unit 1010 and an encoding module 1030. In addition, a storage unit 1050 for storing an audio bitstream obtained as an encoding result may be further included according to the usage of the audio bitstream. In addition, the multimedia device 1000 may further include a microphone 1070. That is, the storage unit 1050 and the microphone 1070 may be optionally provided. The multimedia device 1000 shown in FIG. 28 may further include an arbitrary decoding module (not shown), for example, a decoding module for performing a generic decoding function or a decoding module according to an exemplary embodiment. Herein, the encoding module 1030 may be integrated with other components (not shown) provided to the multimedia device 1000 and be implemented as at least one processor (not shown).

Referring to FIG. 10, the communication unit 1010 may receive at least one of audio and an encoded bitstream provided from the outside or transmit at least one of reconstructed audio and an audio bitstream obtained as an encoding result of the encoding module 1030.

The communication unit 1010 is configured to enable transmission and reception of data to and from an external multimedia device or server through a wireless network such as wireless Internet, a wireless intranet, a wireless telephone network, a wireless local area network (LAN), a Wi-Fi network, a Wi-Fi Direct (WFD) network, a third generation (3G) network, a 4G network, a Bluetooth network, an infrared data association (IrDA) network, a radio frequency identification (RFID) network, an ultra wideband (UWB) network, a ZigBee network, and a near field communication (NFC) network or a wired network such as a wired telephone network or wired Internet.

The encoding module 1030 may encode an audio signal of the time domain, which is provided through the communication unit 1010 or the microphone 1070, according to an embodiment. The encoding process may be implemented using the apparatus or method shown in FIGS. 1 through 9.

The storage unit 1050 may store various programs required to operate the multimedia device 1000.

The microphone 1070 may provide an audio signal of a user or the outside to the encoding module 1030.

Figure 11:
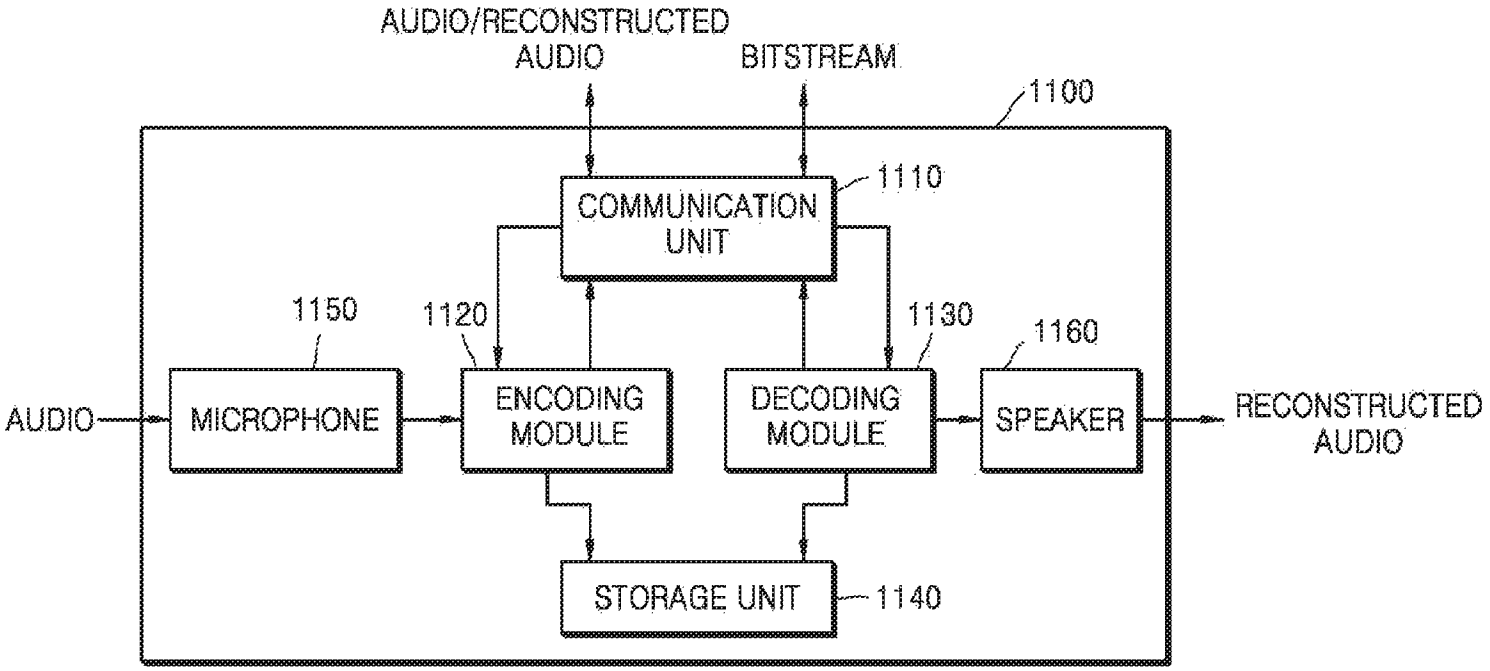
FIG. 11 is a block diagram of a multimedia device according to another exemplary embodiment.

FIG. 11 is a block diagram illustrating a configuration of a multimedia device according to another embodiment.

A multimedia device 1100 shown in FIG. 11 may include a communication unit 1110, an encoding module 1120, and a decoding module 1130. In addition, a storage unit 1140 for storing an audio bitstream obtained as an encoding result or a reconstructed audio signal obtained as a decoding result may be further included according to the usage of the audio bitstream or the reconstructed audio signal. In addition, the multimedia device 1100 may further include a microphone 1150 or a speaker 1160. Herein, the encoding module 1120 and the decoding module 1130 may be integrated with other components (not shown) provided to the multimedia device 1100 and be implemented as at least one processor (not shown).

A detailed description of the same components as those in the multimedia device 1000 shown in FIG. 10 among components shown in FIG. 11 is omitted.

The decoding module 1130 may receive a bitstream provided through the communication unit 1110 and decode an audio spectrum included in the bitstream. The decoding module 1130 may be implemented in correspondence to the encoding module 330 of FIG. 3

The speaker 1170 may output a reconstructed audio signal generated by the decoding module 1130 to the outside.

The multimedia devices 1000 and 1100 shown in FIGS. 10 and 11 may include a voice communication exclusive terminal including a telephone or a mobile phone, a broadcast or music exclusive device including a TV or an MP3 player, or a hybrid terminal device of the voice communication exclusive terminal and the broadcast or music exclusive device but is not limited thereto. In addition, the multimedia device 1000 or 1100 may be used as a transducer arranged in a client, in a server, or between the client and the server.

When the multimedia device 1000 or 1100 is, for example, a mobile phone, although not shown, a user input unit such as a keypad, a display unit for displaying a user interface or information processed by the mobile phone, and a processor for controlling a general function of the mobile phone may be further included. In addition, the mobile phone may further include a camera unit having an image pickup function and at least one component for performing functions required by the mobile phone.

When the multimedia device 1000 or 1100 is, for example, a TV, although not shown, a user input unit such as a keypad, a display unit for displaying received broadcast information, and a processor for controlling a general function of the TV may be further included. In addition, the TV may further include at least one component for performing functions required by the TV.

The methods according to the embodiments may be edited by computer-executable programs and implemented in a general-use digital computer for executing the programs by using a computer-readable recording medium. In addition, data structures, program commands, or data files usable in the embodiments of the present invention may be recorded in the computer-readable recording medium through various means. The computer-readable recording medium may include all types of storage devices for storing data readable by a computer system. Examples of the computer-readable recording medium include magnetic media such as hard discs, floppy discs, or magnetic tapes, optical media such as compact disc-read only memories (CD-ROMs), or digital versatile discs (DVDs), magneto-optical media such as floptical discs, and hardware devices that are specially configured to store and carry out program commands, such as ROMs, RAMs, or flash memories. In addition, the computer-readable recording medium may be a transmission medium for transmitting a signal for designating program commands, data structures, or the like. Examples of the program commands include a high-level language code that may be executed by a computer using an interpreter as well as a machine language code made by a compiler.

Although the embodiments of the present invention have been described with reference to the limited embodiments and drawings, the embodiments of the present invention are not limited to the embodiments described above, and their updates and modifications could be variously carried out by those of ordinary skill in the art from the disclosure. Therefore, the scope of the present invention is defined not by the above description but by the claims, and all their uniform or equivalent modifications would belong to the scope of the technical idea of the present invention.

The invention claimed is:

1. A signal classification method in an encoding device, the signal classification method comprising:

classifying, performed by at least one processor, a current frame as one from among a plurality of classes including a speech class and a music class, based on a first plurality of signal characteristics;

generating a plurality of conditions, based on one or more of a second plurality of signal characteristics obtained from a plurality of frames including the current frame;

first comparing one of the plurality of conditions with a first threshold value and second comparing a hangover parameter with a second threshold value; and correcting a classification result of the current frame, based on a result of the first comparing and second comparing, wherein the second plurality of signal characteristics includes tonalities in a plurality of frequency regions, a long term tonality in a low band, a difference between the tonalities in the plurality of frequency regions, a linear prediction error, and a difference between a scaled voicing feature and a scaled correlation map feature.

2. The signal classification method of claim 1, wherein the second plurality of signal characteristics are obtained from the current frame and a plurality of previous frames.

3. The signal classification method of claim 1, wherein the hangover parameter is used to prevent frequent transitions between states.

4. The signal classification method of claim 1, wherein the correcting comprises correcting the classification result of the current frame from the music class to the speech class when some of the plurality of conditions are satisfied and a first hangover parameter reaches a reference value.

5. The signal classification method of claim 1, wherein the correcting comprises correcting the classification result of the current frame from the speech class to the music class when some of the plurality of conditions are satisfied and a second hangover parameter reaches a reference value.

6. A non-transitory computer-readable recording medium having recorded thereon a program for executing:

classifying a current frame as one from among a plurality of classes including a speech class and a music class, based on a first plurality of signal characteristics;

generating a plurality of conditions, based on one or more of a second plurality of signal characteristics obtained from a plurality of frames including the current frame;

first comparing one of the plurality of conditions with a first threshold value and second comparing a hangover parameter with a second threshold value; and correcting a classification result of the current frame, based on a result of the first comparing and second comparing, wherein the second plurality of signal characteristics includes tonalities in a plurality of frequency regions, a long term tonality in a low band, a difference between the tonalities in the plurality of frequency regions, a linear prediction error, and a difference between a scaled voicing feature and a scaled correlation map feature.

7. An audio encoding method in an encoding device, the audio encoding method comprising:

classifying, performed by at least one processor, a current frame as one from among a plurality of classes including a speech class and a music class, based on a first plurality of signal characteristics;

generating a plurality of conditions, based on a second plurality of signal characteristics obtained from a plurality of frames including the current frame;

first comparing one of the plurality of conditions with a first threshold value and second comparing a hangover parameter with a second threshold value;

correcting a classification result of the current frame, based on a result of the first comparing and second comparing; and encoding the current frame based on the classification result or the corrected classification result, wherein the second plurality of signal characteristics includes tonalities in a plurality of frequency regions, a long term tonality in a low band, a difference between the tonalities in the plurality of frequency regions, a linear prediction error, and a difference between a scaled voicing feature and a scaled correlation map feature.

8. The audio encoding method of claim 7, wherein the encoding is performed using one of a CELP-type coder and a transform coder.

9. The audio encoding method of claim 8, wherein the encoding is performed using one of the CELP-type coder, the transform coder and a CELP/transform hybrid coder.

10. A signal classification apparatus implemented in an encoding device, the signal classification apparatus comprising at least one processor configured to:

classify a current frame as one from among a plurality of classes including a speech class and a music class, based on a first plurality of signal characteristics, generate a plurality of conditions, based on one or more of a second plurality of signal characteristics obtained from a plurality of frames including the current frame, first compare one of the plurality of conditions with a first threshold value, second compare a hangover parameter with a second threshold value and correct a classification result of the current frame, based on a result of the first comparing and second comparing, wherein the second plurality of signal characteristics includes tonalities in a plurality of frequency regions, a long term tonality in a low band, a difference between the tonalities in the plurality of frequency regions, a linear prediction error, and a difference between a scaled voicing feature and a scaled correlation map feature.

11. An audio encoding apparatus implemented in an encoding device, the audio encoding apparatus comprising at least one processor configured to:

classify a current frame as one from among a plurality of classes including a speech class and a music class, based on a first plurality of signal characteristics, generate a plurality of conditions, based on one or more of a second plurality of signal characteristics obtained from a plurality of frames including the current frame, first compare one of the plurality of conditions with a first threshold value, second compare a hangover parameter with a second threshold value, correct a classification result of the current frame, based on a result of the first comparing and second comparing, and encode the current frame based on the classification result or the corrected classification result, wherein the second plurality of signal characteristics includes tonalities in a plurality of frequency regions, a long term tonality in a low band, a difference between the tonalities in the plurality of frequency regions, a linear prediction error, and a difference between a scaled voicing feature and a scaled correlation map feature.

* * * * *